US009588449B2

(12) United States Patent
Ron et al.

(10) Patent No.: US 9,588,449 B2
(45) Date of Patent: Mar. 7, 2017

(54) ELECTROSTATIC PRINTING

(75) Inventors: Hannoch Ron, Kadima (IL); Inna Tzomik, Modiin (IL); Shani Maor, Tel Aviv (IL); Eran Goldenberg, Kfar Bilu (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 14/375,028

(22) PCT Filed: Feb. 15, 2012

(86) PCT No.: PCT/EP2012/052621

§ 371 (c)(1),
(2), (4) Date: Jul. 28, 2014

(87) PCT Pub. No.: WO2013/120523

PCT Pub. Date: Aug. 22, 2013

(65) Prior Publication Data

US 2015/0004378 A1 Jan. 1, 2015

(51) Int. Cl.
*G03G 7/00* (2006.01)
*B41J 2/41* (2006.01)

(52) U.S. Cl.
CPC ..... *G03G 7/0046* (2013.01); *B41J 2/41* (2013.01); *G03G 7/002* (2013.01); *G03G 7/0006* (2013.01); *G03G 7/008* (2013.01); *G03G 7/0026* (2013.01); *Y10T 428/24802* (2015.01)

(58) Field of Classification Search
CPC ..... Y10T 428/24802
See application file for complete search history.

(56) References Cited

U.S. PATENT DOCUMENTS

| | | | | |
|---|---|---|---|---|
| 5,192,638 | A | 3/1993 | Landa et al. | |
| 5,266,435 | A | 11/1993 | Almog | |
| 5,346,796 | A | 9/1994 | Almog | |
| 5,518,809 | A | 5/1996 | Henry et al. | |
| 5,629,400 | A | 5/1997 | Standke et al. | |
| 5,679,147 | A | 10/1997 | Standke et al. | |
| 5,808,125 | A | 9/1998 | Standke et al. | |
| 5,922,161 | A | 7/1999 | Wu et al. | |
| 6,070,042 | A | 5/2000 | Landa et al. | |
| 6,136,382 | A | 10/2000 | Kamen et al. | |
| 6,337,168 | B1 | 1/2002 | Almog | |
| 6,491,838 | B1 | 12/2002 | Standke et al. | |
| 7,317,062 | B2 | 1/2008 | Pritschins et al. | |
| 7,736,693 | B2 | 6/2010 | Garbar et al. | |
| 7,985,821 | B2 | 7/2011 | Lejeune et al. | |
| 8,025,918 | B2 | 9/2011 | Broguiere et al. | |
| 8,029,964 | B1 | 10/2011 | Almanza-Workman | |
| 2003/0181566 | A1* | 9/2003 | Chapman | B41M 5/5218 524/492 |
| 2004/0151881 | A1 | 8/2004 | Almog et al. | |
| 2007/0112093 | A1 | 5/2007 | Almog et al. | |
| 2009/0043081 | A1* | 2/2009 | Arai | C09B 29/0037 534/617 |
| 2010/0239871 | A1 | 9/2010 | Scheffer et al. | |
| 2011/0123228 | A1* | 5/2011 | Roditi et al. | 399/237 |

FOREIGN PATENT DOCUMENTS

| | | |
|---|---|---|
| EP | 0663620 | 7/1995 |
| EP | 0716127 | 6/1996 |
| EP | 0716128 | 6/1996 |
| EP | 0775590 | 5/1997 |
| EP | 0846717 | 6/1998 |
| EP | 1101787 | 5/2001 |
| WO | WO-96/06384 | 2/1996 |
| WO | WO-99/19773 | 4/1999 |
| WO | WO-2005/007304 | 1/2005 |
| WO | WO-2007/085320 | 8/2007 |
| WO | WO-2007/130069 | 11/2007 |

OTHER PUBLICATIONS

Degussa creating essentials, Productation sheet, Dynasylan Hydrosil 2627, pp. 1-3.
Evonik industries brochure, Dynasylan® Product Range, 9 pages.
Evonik industries, Dynasylan® functional siianes HYDROSIL, Nov. 22, 2011 (http://www.dynasylan.com/product/dynasylan/en/products/product-groups/dynasylan- . . . ).
Witucki, Gerald L., "A Silane Primer: Chemistry and Applications of Alkoxy Silanes", Journal of Coatings Technology Reprint, issued Jul. 1993, 4 pages.

* cited by examiner

*Primary Examiner* — Gerard Higgins
*Assistant Examiner* — Sathavaram I Reddy
(74) *Attorney, Agent, or Firm* — Dierker & Kavanaugh, P.C.

(57) ABSTRACT

There is provided a method for electrostatic printing comprising providing a print substrate having a layer comprising a polymeric material, the layer comprising a polymeric material having thereon a surface layer comprising an aminofunctional silane; carrying out an electrostatic printing process to transfer an ink onto the surface layer comprising the aminofunctional silane. Also disclosed herein are print substrates producible by the method, and print substrates for use in the method.

11 Claims, 1 Drawing Sheet

ELECTROSTATIC PRINTING

BACKGROUND

In general, electrostatic printing processes involve creating an image on a photoconductive surface, applying an ink having charged particles to the photoconductive surface, such that they selectively bind to the image, and then transferring the charged particles in the form of the image to a print substrate.

The photoconductive surface is typically on a cylinder and is often termed a photo imaging plate (PIP). The photoconductive surface is selectively charged with a latent electrostatic image having image and background areas with different potentials. For example, an electrostatic ink composition comprising charged toner particles in a carrier liquid can be brought into contact with the selectively charged photoconductive surface. The charged toner particles adhere to the image areas of the latent image while the background areas remain clean. The image is then transferred to a print substrate (e.g. paper) directly or, more commonly, by being first transferred to an intermediate transfer member, which can be a soft swelling blanket, and then to the print substrate. Variations of this method utilize different ways for forming the electrostatic latent image on a photoreceptor or on a dielectric material.

DETAILED DESCRIPTION

Figure 1:
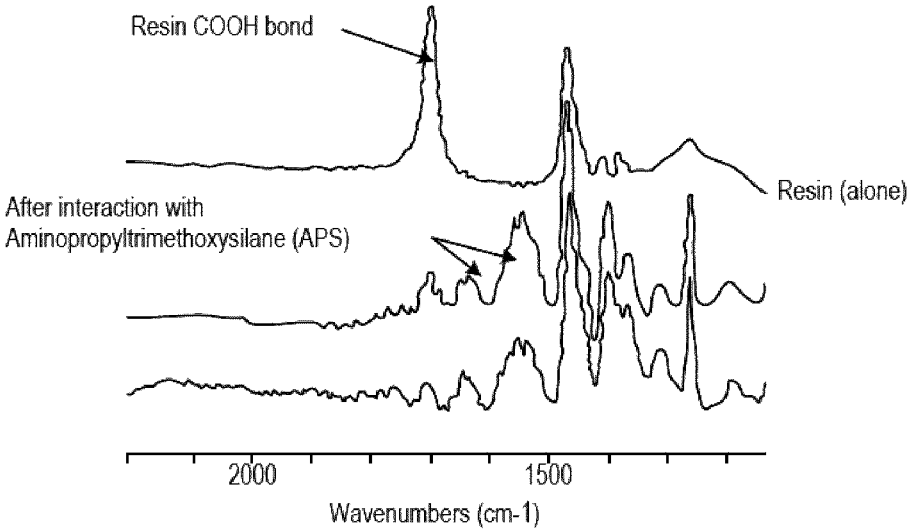
FIG. 1 shows IR spectra for an acidic resin, both before and after reaction with a certain aminofunctional silane. More detail is given in the Examples below.

Before the present invention is disclosed and described, it is to be understood that this invention is not limited to the particular process steps and materials disclosed herein because such process steps and materials may vary somewhat. It is also to be understood that the terminology used herein is used for the purpose of describing particular examples only. The terms are not intended to be limiting because the scope of the present invention is intended to be limited only by the appended claims and equivalents thereof.

It is noted that, as used in this specification and the appended claims, the singular forms "a," "an," and "the" include plural referents unless the context clearly dictates otherwise.

As used herein, "carrier liquid," "carrier," or "carrier vehicle" refers to the fluid in which the polymers, particles, colorant, charge directors and other additives can be dispersed to form a liquid electrostatic (or electrophotographic) ink composition. Such carrier liquids and vehicle components are known in the art. Typical carrier liquids can include a mixture of a variety of different agents, such as surfactants, co-solvents, viscosity modifiers, and/or other possible ingredients.

As used herein, "electrostatic ink composition" generally refers to a toner composition that is typically suitable for use in an electrostatic or electrophotographic printing process.

As used herein, "pigment" generally includes pigment colorants, magnetic particles, aluminas, silicas, and/or other ceramics or organo-metallics, whether or not such particulates impart color. Thus, though the present description primarily exemplifies the use of pigment colorants, the term "pigment" can be used more generally to describe not only pigment colorants, but other pigments such as organometallics, ferrites, ceramics, etc.

As used herein, "copolymer" refers to a polymer that is polymerized from at least two monomers.

A certain monomer may be described herein as constituting a certain weight percentage of a polymer. This indicates that the repeating units formed from the said monomer in the polymer constitute said weight percentage of the polymer.

As used herein, "electrostatic printing" or "electrophotographic printing" generally refers to the process that provides an image that is transferred from a photo imaging substrate either directly or indirectly to a printing substrate (such paper), typically via an intermediate transfer member. As such, the image is not substantially absorbed into the photo imaging substrate on which it is applied. Additionally, "electrophotographic printers" generally refer to those printers capable of performing electrophotographic printing, as described above. "Liquid electrophotographic printing" or "liquid electrostatic printing" is a specific type of electrophotographic printing where a liquid ink is employed in the electrophotographic process rather than a powder toner.

Standard tests are mentioned herein, e.g. ISO tests, and, unless indicated to the contrary, each standard test is the most recent version at the time of filing this application.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

Unless otherwise stated, any feature described herein can be combined with any aspect or any other feature described herein.

In a first aspect, there is provided a method for electrostatic printing comprising providing a print substrate having a layer comprising a polymeric material, the layer comprising a polymeric material having thereon a surface layer comprising an aminofunctional silane;

carrying out an electrostatic printing process to transfer an ink onto the surface layer comprising the aminofunctional silane.

In a second aspect, there is provided a print substrate producible according to the method of the first aspect. In a second aspect, there is provided a print substrate having a layer comprising a polymeric material, the layer comprising a polymeric material having thereon a layer comprising an aminofunctional silane; the layer comprising an aminofunctional silane having printed thereon an ink comprising a resin comprising acidic side groups.

In a third aspect, there is provided a print substrate having a layer comprising a polymeric material, the layer comprising a polymer having thereon a surface layer comprising a non-halogenated aminofunctional oligomericsiloxane.

The present inventors have found that they can prime the surface of print substrates, including both plastic and paper substrates, by applying aminofunctional silanes. They have found that this increases adhesion of electrostatic printing inks, particularly those containing acidic side groups, when printed on the substrate. It has been a considerable challenge to date to find a way of priming substrates that allows successful adhesion of electrostatic printing inks to some substrates, particularly plastic substrates, while avoiding harm to the environment. In some examples, the present inventors have found certain aminofunctional silanes can be applied to a substrate in an aqueous solution, and still prime the surface so that electrostatic printing inks can be adhered to the substrate. This has been found with many substrates, including, but not limited to, plastic substrates and uncoated cellulosic substrates, both of which do not adhere well to some electrostatic inks. The present inventors also found that some of the prior art primers tended, over an extended period of time in an electrostatic printing process, to come off the printing substrates on which they were coated, coat the rollers, creating a build-up of dried materials in the printing apparatus. They also found that some other prior art primers had a tendency to yellow after plasma treatment. Other prior art primers for electrostatic inks require two-layers of different primers, one of the layers adhering to the substrate, with the other layer adhering to the ink. The present inventors sought to provide a primer that avoided or at least mitigated one of the problems associated with the prior art primers, whether or not expressly mentioned herein.

Substrate

The print substrate has a layer comprising a polymeric material. The substrate may also comprise further layers. In the aspects described above, the polymeric material of the substrate may be in contact with the aminofunctional silane or aminofunctional oligomericsiloxane. In the method described above, the aminofunctional silane may, before the electrostatic printing, be located on an exposed surface of the substrate, such that, during the printing, the ink contacts and adheres to the aminosilane. The polymeric material may comprise a natural polymeric material, e.g. cellulose. The material may comprise a synthetic polymeric material, e.g. a polymer formed from alkylene monomers. The polymeric material may comprise a plastic. The plastic may be selected from polyethylene terephthalate (PET), a polyalkylene, such as polyethylene or polypropylene, polyvinylchloride, polycarbonate, and styrene-butadiene. In some examples, the plastic may comprise or be biaxially orientated polypropylene (BOPP).

In some examples, the substrate or the layer comprising the polymeric material comprises a cellulosic paper, which may be coated or an uncoated cellulosic paper, which may have thereon the surface layer comprising the aminofunctional silane. A coated cellulosic paper includes, but is not limited to, a cellulosic paper coated with a non-cellulosic material. In some examples, the cellulosic paper is coated with a non-cellulosic polymeric material, e.g. selected from polyethylene terephthalate (PET), a polyalkylene, such as polyethylene or polypropylene, polyvinylchloride, polycarbonate, and styrene-butadiene. The polymeric material may lack hydroxyl side groups. In some examples, the cellulosic paper has an inorganic material bound to its surface (before application of the aminofunctional silane and/or printing with ink) with a polymeric material, wherein the inorganic material, which may be in particulate form, may be selected from, for example, kaolinite or calcium carbonate. In some examples, the coated cellulosic paper may comprise a cellulosic paper coated with a polymeric material into which is dispersed an inorganic material, which may be a particulate inorganic material, which may be selected from for example kaolinite or calcium carbonate. It has been found that the method of the present invention is particularly effective at priming cellulosic paper, particularly an uncoated cellulosic paper. An uncoated cellulosic paper may be one that lacks the coatings mentioned above, for example lacking a coating of a non-cellulosic polymer and/or inorganic material, which may be in particulate form and dispersed in the non-cellulosic polymer.

In some examples, the substrate comprises or consists of a cellulosic paper, which may be uncoated or coated cellulosic paper, having a Bekk smoothness, as measured using the ISO 5627 test, of 1000 s or less, in some examples 500 s or less, in some examples 200 s or less, in some examples 150 s or less, in some examples 100 s or less, in some examples 50 s or less in some examples 40 s or less, in some examples 30 s or less, in some examples 20 s or less, in some examples 15 s or less, in some examples 10 s or less. The Bekk smoothness test is a standard test, as measured using the ISO 5627 test, for determining the smoothness of paper, with a higher value indicating a very smooth surface, and a lower value indicating a rough surface. The present inventors found that, in the absence of the aminofunctional silanes described herein, some electrostatic inks did not adhere well to rough cellulosic paper substrates. However, the aminofunctional silanes described herein, allowed greater adhesion of the electrostatic inks to the cellulosic paper.

Aminofunctional Silane

In some examples, the aminofunctional silane is a silane compound in which an amino group is attached to a silicon atom via a linker group. The linker group may be a non-hydrolysable linker group. In, some examples, the non-hydrolysable linker may be or may comprise an optionally substituted hydrocarbon group. The non-hydrolysable linker may comprise a hydrocarbon group having one or more heteroatoms in its structure. For example, the non-hydrolysable linker may comprise a hydrocarbon group having a moiety selected from an ester, ether and amide within its structure, and, in some examples, the hydrocarbon group is directly covalently bonded to the Si in the organosilane by a carbon atom. The non-hydrolysable linker may be selected from alkylene, alkenylene and alkynylene and may have 1 to 20 carbon atoms in its structure. The amino group may be a primary, secondary or tertiary amino group.

The aminofunctional silane may comprise a hydrolysable group bound to a silicon atom of the silane. The aminofunctional silane may comprise a plurality of hydrolysable groups bound to a silicon atom of the silane. The hydrolysable group or groups may be of the formula $OR_A$, wherein $R_A$ is a hydrocarbyl group, wherein the hydrocarbyl group may be selected from, for example an alkyl, alkenyl, alkynyl and acyl. The hydrocarbyl group in $R_A$ may contain 1 to 10 carbon atoms. In some examples, $R_A$ is an optionally substituted alkyloxy group. The optionally substituted alkyloxy group may contain, excluding any substituents that may be present, from 1 to 10 carbon atoms, in some examples from 1 to 5 carbon atoms, in some examples 1 to 3 carbon atoms. In some examples $R_A$ is OMe or OEt.

In some examples, the aminofunctional organosilane is of the formula $X—SiR_1R_2R_3$, wherein $R_1$, $R_2$ and $R_3$ are all hydrolysable groups, and X comprises an amino group which is covalently bonded to Si in $X—SiR_1R_2R_3$ via a non-hydrolysable linker group.

In some examples, X is an optionally substituted amino group that is covalently bonded to Si in $X—SiR_1R_2R_3$ via the non-hydrolysable linker group. The non-hydrolysable linker may be or may comprise an optionally substituted hydrocarbon group. The non-hydrolysable linker may comprise a hydrocarbon group having one or more heteroatoms in its structure. For example, the non-hydrolysable linker may comprise a hydrocarbon group having a moiety selected from an ester, ether and amide within its structure, as long as the hydrocarbon group is directly covalently bonded to the Si in the organosilane by a carbon atom. The non-hydrolysable linker may be selected from alkylene, alkenylene and alkynylene and may have 1 to 20 carbon atoms in its structure.

In some examples, X is an optionally substituted aminoalkyl group, which, in some examples, may contain, excluding any substituents, 1 to 20 carbon atoms, in some examples 1 to 10 carbon atoms, in some examples 1 to 5 carbon atoms, in some examples 2 to 4 carbon atoms. In the substituted aminoalkyl group, either the amino group or the alkyl group may have one or more substituents thereon. In some examples, the amino group has a substituent selected from $NH_2—(CH_2)_m—$ and $SiR_5R_6R_7—(CH_2)_m—$ thereon, wherein m is 1 to 10 and $R_5$ $R_6$ and $R_7$ are all hydrolysable groups, which may be as described herein for $R_1$, $R_2$ and $R_3$, and may be the same as or different from $R_1$, $R_2$ and $R_3$.

In some examples, X is of the formula $NHR_4—(CH_2)_n—$, wherein $R_4$ is selected from H and optionally substituted alkyl and n is 1 to 10.

In some examples, X is of the formula $NHR_4—(CH_2)_n—$, wherein n is 1 to 10 and $R_4$ is selected from H, $NH_2—(CH_2)_m—$ and $SiR_5R_6R_7—(CH_2)_m—$, wherein m is 1 to 10, wherein $R_5$, $R_6$ and $R_7$ are all hydrolysable groups, which may be as described herein for $R_1$, $R_2$ and $R_3$, and may be the same as or different from $R_1$, $R_2$ and $R_3$.

In some examples, wherein $R_1$, $R_2$, $R_3$ and, if present, $R_5$, $R_6$ and $R_7$, are each independently a group of the formula $OR_8$, wherein $R_8$ is a hydrocarbyl group, wherein the hydrocarbyl group may be selected from, for example an alkyl, alkenyl, alkynyl and acyl. The hydrocarbyl group in $R_8$ may contain 1 to 10 carbon atoms. In some examples, wherein $R_1$, $R_2$, $R_3$ and, if present, $R_5$, $R_6$ and $R_7$, are each independently an optionally substituted alkyloxy group. The optionally substituted alkyloxy group may contain, excluding any substituents that may be present, from 1 to 10 carbon atoms. in some examples from 1 to 5 carbon atoms, in some examples 1 to 3 carbon atoms. IN some examples, $R_1$, $R_2$, $R_3$ and, if present, $R_5$, $R_6$ and $R_7$, are each OMe.

In some examples, the aminofunctional silane is selected from aminopropyltrimethoxysilane (APS), aminopropyltriethoxysilane (APES), aminoethylaminopropyltrimethoxysilane (APMS), N-aminohexyl aminomethyltrimethoxysilane (AZA-APA), aminophenoxypropyltrimethoxysilane (APHENMS), bistrimethoxysilylpropylamine (BTMSA), bis-triethoxysilylpropylamine (BTESA), and mixtures thereof.

In some examples, the aminofunctional organosilane is or comprises an aminofunctional oligomericsiloxane, which may, in some examples, be termed an aminofunctional organopolysiloxane. In some examples, the aminofunctional oligomericsiloxane comprises at least two silicon atoms linked covalently by an oxygen atom (Si—O—Si), and at least one of the silicon atoms is attached to an amino group via a linker group. The linker group may be a non-hydrolysable linker group. In, some examples, the non-hydrolysable linker may be or may comprise an optionally substituted hydrocarbon group. The non-hydrolysable linker may comprise a hydrocarbon group having one or more heteroatoms in its structure. For example, the non-hydrolysable linker may comprise a hydrocarbon group having a moiety selected from an ester, ether and amide within its structure, and, in some examples, the hydrocarbon group is directly covalently bonded to the Si in the organosilane by a carbon atom. The non-hydrolysable linker may be selected from alkylene, alkenylene and alkynylene and optionally have 1 to 20 carbon atoms in its structure.

In some examples, the aminofunctional oligomericsiloxane is obtainable mixing a aminoalkoxysilane of formula I $$R^a—Si(R^b)_y(OR^c)_{3-y} \quad (I)$$

with an alkylalkoxysilane of formula II $$R^d—Si(OR^e)_3 \quad (II)$$

and/or dialkyldialkoxysilanes of the formula (II)*

$$BB'—Si(OR^f)_2 \quad (II)^*$$

wherein $R^a$ is an aminofunctional group,
$R^b$, $R^c$, $R^e$ and $R^f$ are each independently an alkyl group,
$R^d$ is an alkyl, alkene or a ureido-alkyl group, and
B and B' are each independently an alkyl or an alkene group, and $0 \leq y \leq 1$.

The aminoalkoxysilane of formula I may be selected from, for example, aminopropyltrimethoxysilane (APS), aminopropyltriethoxysilane (APES), aminoethylaminopropyltrimethoxysilane (APMS), N-aminohexyl aminomethyltrimethoxysilane (AZA-APA), aminophenoxypropyltrimethoxysilane (APHENMS), bistrimethoxysilylpropylamine (BTMSA), bis-triethoxysilylpropylamine (BTESA), and, in some examples, may be mixed with the specific alkylalkoxysilane of formula II and/or dialkyldialkoxysilanes of the formula (II)* mentioned below.

The alkylalkoxysilane of formula II may be selected from, for example, alkyltrimethoxysilanes and alkyltriethoxysilanes, for example C1-10 alkyltrimethoxysilanes and C1-10 alkyltriethoxysilanes, for example C1-5 alkyltrimethoxysilanes and C1-5 alkyltriethoxysilanes, C1-3 alkyltrimethoxysilanes and C1-3 alkyltriethoxysilanes; alkene trimethoxysilanes and alkene triethoxysilanes, for example vinyltrimethoxysilane and vinyltriethoxysilane. Alkylalkoxysilane of formula II may be selected from, for example, methyltrimethoxysilane, methyltriethoxysilane, ethyltrimethoxysilane, ethyltriethoxysi lane, propyltrimethoxysi lane, propyltriethoxysilane vinyltrimethoxysi lane, vinyltriethoxysilane, isobutyltrimethoxysilane, and ureidopropyltrimethoxysilane.

The dialkyldialkoxysilanes of the formula (II)* may be selected from, for example, dialkyldimethoxysilanes and dialkyldiethoxysilanes, for example C1-10 dialkyldimethoxysilanes and C1-10 dialkyldiethoxysilanes, for example C1-5 dialkyldimethoxysilanes and C1-5 dialkyltdiethoxysilanes, C1-3 dialkyldimethoxysilanes and C1-3 dialkyldiethoxysilanes; dialkene dimethoxysilanes and dialkene diethoxysilanes, for example divinyldimethoxysilane and divinyldiethoxysilane. The alkylalkoxysilane of formula II may be selected from, for example, dimethyldimethoxysilane, dimethyldiethoxysilane, diethyldimethoxysilane, diethyldiethoxysilane, dipropyldimethoxysilane, dipropyldiethoxysilane divinyldimethoxysilane, divinyldiethoxysilane, diisobutyldimethoxysilane and diisobutyldiethoxysilane.

In some examples, the aminofunctional oligomericsiloxane is obtainable by a first process of mixing a water soluble aminoalkoxysilane of formula I $$R^a—Si(R^b)_y(OR^c)_{3-y} \quad (I)$$

with a water-insoluble alkylalkoxysilane of formula II $$R^d—Si(OR^e)_3 \quad (II)$$

wherein $R^a$ is an aminofunctional group,
$R^b$, $R^c$, and $R^e$ are each independently an alkyl group, which, in some examples, is selected from C1 to C4 alkyl, which, in some examples is selected from methyl and ethyl,
$R^d$ is an alkyl, alkene or a ureido-alkyl group,
$0 \le y \le 1$,
adding water to the mixture,
if desired, adjusting the pH of the reaction mixture to a value of from 1 to 8, or from 8 to 14
and removing the alcohol already present and/or formed during the reaction.

In some examples, $R^a$ is an aminofunctional group of formula III $$[Z_{(f+cf^*)}]^{(f+cf^*)-}[A_dNH_{(2+f-d)}—[(CH_2)_a—NA^1{}_e H_{(1-e+f^*)}—]_c(CH_2)_b—]^{(f+cf^*)+} \quad (III)$$

wherein $1 \le a \le 6$, $1 \le b \le 6$, $0 \le c \le 6$, $0 \le d \le 2$, $0 \le e \le 1$, $0 \le f \le 1$, $0 \le f^* \le 1$
A and $A^1$ is a benzyl or vinyl benzyl group N is a nitrogen atom, Z is a monovalent inorganic or organic acid radical, including, but not limited to, inorganic or organic acid radicals selected from the group of halides, e.g. chlorides and bromides, nitrate, and carboxylic acid ions, such as formate and acetate.

In some examples, the aminofunctional oligomericsiloxane is obtainable by the first process, which involves mixing Q mol of the water soluble aminoalkoxysilane of formula I with M mol of the water-insoluble alkylalkoxysilane of formula II, and in some examples, $0 \le M/Q \le 2$, in some examples $0.5 \le M/Q \le 2$, in some examples $0.8 \le M/Q \le 1.2$, in some examples M/Q is about 1.

In some examples, $R^d$ is a linear or cyclic or branched alkyl group having 1 to 6 C atoms or a ureido-alkyl group or the formula IV $$NH_2—CO—NH—(CH_2)_b— \text{ where } 1 \le b \le 6. \quad (IV)$$

The aminofunctional oligomericsiloxane may be as described in EP-A-0716127.

In some examples, the aminofunctional oligomericsiloxane is obtainable by mixing a water soluble aminoalkoxysilane of formula I $$R^a—Si(R^b)_y(OR^c)_{3-y} \quad (I)$$

with a water-insoluble alkylalkoxysilane of formula II $$R^d—Si(OR^e)_3 \quad (II)$$

and/or dialkyldialkoxysilanes which are not water soluble, of the formula (II)*

$$BB'—Si(OR^f)_2 \quad (II)^*$$

and/or mixtures of alkyltrialkylalkoxysilanes and dialkyldialkoxysilanes which are not water-soluble of the formula (II) and (II)*
wherein $R^a$ is an aminofunctional group,
$R^b$, $R^c$, $R^e$ and $R^f$ are each independently an alkyl group, which, in some examples, is selected from C1 to C4 alkyl, which, in some examples is selected from methyl and ethyl,
$R^d$ is an alkyl, alkene or a ureido-alkyl group,
B and B' are each independently an alkyl group, which may be an unbranched or branched alkyl group, which may have 1 to 3 C atoms,
$0 \le y \le 1$,
adding water to the mixture,
if desired, adjusting the pH of the reaction mixture to a value of from 1 to 8, or from 8 to 14,
and removing the alcohol already present and/or formed during the reaction.

In some examples, $R^a$ is an aminofunctional group of formula III*

$$[Z_{(f+g+h)}]^{(f+g+h)-}[NH_{(2+f)}[(CH_2)_b—(NH_{g+1})_c](CH_2)_d (NH_{h+1})_e(CH_2)_i]^{(f+g+h)+}— \quad (III^*)$$

wherein $0 \le b \le 3$, $0 \le d \le 3$, $0 \le i \le 3$, $0 \le f \le 1$, $0 \le f \le 1$, $0 \le g \le 1$, $0 \le h \le 1$, $0 \le c \le 1$, $0 \le e \le 1$, $b+d+i \ne 0$, if b=0 then c=0, if d=0 then e=0, if i=0 then e=0, if d=i=0 then c=0, N is a nitrogen atom, Z is a monovalent inorganic or organic acid radical, including, but not limited to, inorganic or organic acid radicals selected from the group of halides, e.g. chlorides and bromides, nitrate, and carboxylic acid ions, such as formate and acetate.

In some examples, Q is the sum of the number of moles of the aminoalkylsilanes of the general formula (I) and M is the sum of the numbers of moles of the alkyltrialkoxysilanes of the formula (II) and of the dialkyldialkoxysilanes of the formula (II)*, and in some examples, $0 \le M/Q2$, in some examples $0.5 \le M/Q \le 2$, in some examples $0.8 \le M/Q \le 1.2$, in some examples M/Q is about 1.

In some examples, $R^d$ is a linear or cyclic or branched alkyl group having 1 to 6 C atoms or a ureido-alkyl group or the formula IV $$NH_2—CO—NH—(CH_2)_b— \text{ where } 1 \le b \le 6. \quad (IV)$$

The aminofunctional silane may be as described in EP-A-0716128.

The layer comprising the polymeric material has thereon a surface layer comprising an aminofunctional silane. The layer comprising the polymeric material may be absent the aminofunctional silane. In some examples, the polymeric material and the aminofunctional silane are in direct contact. In some examples, the aminofunctional silane on the layer comprising the polymeric material is exposed, which allows ink to be transferred directly onto the aminofunctional silane during an electrostatic printing process.

The method may comprise forming the print substrate having the layer comprising a polymeric material, the layer comprising a polymeric material having thereon the surface layer comprising an aminofunctional silane, by providing a print substrate having a layer comprising a polymeric material and applying the aminofunctional silane to the layer comprising the polymeric material. The aminofunctional silane may or may not be applied in a carrier liquid. In some examples, the aminofunctional silane may be applied in water. Accordingly, the method may comprise providing a composition comprising a liquid carrier and the aminofunctional silane, and applying the composition comprising the liquid carrier and the aminofunctional silane to the layer comprising the polymeric material of the print substrate. The liquid carrier may be removed, e.g. by evaporation, from the composition applied to the layer comprising the polymeric material of the print substrate to form a solid layer comprising the aminofunctional silane on the layer comprising the polymeric material. In some examples, the method may comprise providing an aqueous composition comprising water and the aminofunctional silane, and applying the aqueous composition to the layer comprising the polymeric material of the print substrate. The water may be removed, e.g. by evaporation, from the composition applied to the layer comprising the polymeric material of the print substrate to form a solid layer comprising the aminofunctional silane on the layer comprising the polymeric material.

In some examples, before applying the aminofunctional silane to the layer of the substrate comprising the polymeric material, the layer comprising the polymeric material may be subjected to a corona treatment. This has been found to assist adhesion of the aminofunctional silane to the substrate, and, of the ink to substrate, once printed onto the aminofunctional silane.

In an aspect, there is provided a method for producing a coated print substrate for printing thereon,

- providing a print substrate having a layer comprising a polymeric material and an aqueous composition comprising an aminosilane
- applying the aqueous composition comprising an aminosilane to the layer comprising a polymeric material
- allowing the print substrate to dry to form a layer of the aminosilane on the print substrate to form the coated print substrate.

The aqueous composition comprising the aminofunctional silane may be formable by the first or second processes described above. In some examples, the aqueous composition comprising the aminofunctional silane contains substantially no (e.g. less than 10 ppm) or no organic solvents. In some examples, the aqueous composition comprising the aminofunctional silane contains substantially no or no organic solvents selected from aliphatic or aromatic hydrocarbons, halogenated hydrocarbons, glycols, glycol ethers, ethers, ketones, esters, amides, sulphur-containing solvents, nitro-containing solvents. In some examples, the aqueous composition comprising the aminofunctional silane contains substantially no (e.g. less than 5% by weight, in some examples less than 1.5% by weight, in some examples less than 0.5% by weight) or no alcohols, for example, alcohols selected from C1-C10 alkanols, for example C1-C3 alkanols selected from methanol, ethanol, iso- and n-propanol.

The aqueous composition may have a pH of from 1 to 8, in some examples of from 3 to 6, in some examples of from 3 to 5. The aqueous composition may comprise a monobasic acid, e.g. a monobasic organic or inorganic acid, which may be of formula ZH, where Z is as defined above. In some examples, the monobasic acid may be selected from nitric acid, hydrochloric acid, acetic acid and formic acid. The aqueous composition may have a pH of from 8 to 14, in some examples of from 8 to 12, in some examples of from 10 to 12, in some examples about 11.

The aqueous composition may comprise from 0.5 to 30 mol of water, in some examples 1 to 5 mol, per total mol of organosilanes, which may of formula (I), (II) and (II)*, in the aqueous composition.

The aqueous composition may have a flash point above 70° C., in some examples above 95° C., in some examples, above 98° C.

In some examples, the aqueous composition develops no or essentially no hydrolysis alcohols on addition of water. In some examples, the aqueous composition contains substantially no (e.g. less than 5% by weight) or no alcohols, as described above.

In some examples, the aqueous composition may contain from 1 wt % to 50 wt % aminofunctional silane, in some examples 1 wt % to 30 wt % aminofunctional silane, in some examples 5 wt % to 25 wt % aminofunctional silane, in some examples from 10 wt % to 20 wt % aminofunctional silane.

The aminofunctional silane may be present on the layer comprising the polymeric material in an amount of at least 0.01 g of aminofunctional silane per square meter of the layer comprising the polymeric material (GSM), in some examples at least 0.02 GSM, in some examples at least 0.03 GSM. The aminofunctional silane may be present on the layer comprising the polymeric material in an amount of from 0.01 to 1 g of aminofunctional silane per square meter of the layer comprising the polymeric material (GSM), in some examples in an amount of from 0.01 to 0.5 GSM, in some examples in an amount of from 0.03 to 0.3 GSM, in some examples in an amount of from 0.05 to 0.2 GSM, in some examples in an amount of from 0.05 to 0.5 GSM.

The electrostatic printing process may comprise:

- forming a latent electrostatic image on a surface;
- contacting the surface with an ink composition comprising particles comprising a resin, such that at least some of the particles adhere to the surface to form a developed toner image on the surface, and transferring the toner image onto the surface layer comprising the aminofunctional silane of the print substrate.

In some examples, the resin particles of the ink directly contact the aminofunctional silane on the print substrate.

The surface on which the latent electrostatic image is formed may be a photoconductive surface. The surface on which the latent electrostatic image is formed may be on a rotating member, e.g. in the form of a cylinder. The surface on which the latent electrostatic image is formed may form part of a photo imaging plate (PIP). The contacting may involve passing the ink composition between a stationary electrode and a rotating member, which may be a member having the surface having a latent electrostatic image thereon or a member in contact with the surface having a latent electrostatic image thereon. A voltage is applied between the stationary electrode and the rotating member, such that the particles adhere to the surface of the rotating member. This may involve subjecting the ink composition to an electric field having a field of 50-400 V/μm, or more, in some examples 600-900 V/μm, or more.

The intermediate transfer member may be a rotating flexible member, which is in some examples is heated, e.g. to a temperature of from 80 to 160° C., in some examples from 90 to 130° C., in some examples from 100 to 110° C.

The method of the first aspect may be carried out so that a plurality of impressions or copies are carried out. The number of impressions or copies may be at least 100, in some examples at least 500, in some examples at least 1000, in some examples at least 2000, in some examples at least 3000, in some examples at least 5000. An impression may be a single image of one colour formed on a print substrate. A copy may be a single image having a plurality of colours, e.g. selected from black, magenta, cyan and yellow.

The method of the first aspect may be carried out so that a plurality of print substrate sheets are printed, for example 250 or more print substrate sheets, in some examples 500 or more print substrate sheets, in some examples 750 or more print substrate sheets, in some examples 1000 or more print substrate sheets. The sheets may be any suitable size or shape, e.g. of standard printing size, such as A4 or A3.

The ink composition and/or the ink transferred onto the surface layer comprising the aminofunctional silane may include a resin. The ink composition and/or the ink transferred onto the surface layer comprising the aminofunctional silane may include particles comprising a resin. The resin may include a thermoplastic polymer, which, in some examples, is a thermoplastic polymer having acidic side groups. In some examples, the polymer of the resin may be selected from ethylene acrylic acid copolymers; methacrylic acid copolymers; ethylene vinyl acetate copolymers; copolymers of ethylene (e.g. 80 wt % to 99.9 wt %) and alkyl (e.g. C1 to C5) ester of methacrylic or acrylic acid (e.g. 0.1 wt % to 20 wt %); copolymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g. copolymer of acrylic or methacrylic acid and at least one alkyl ester of acrylic or methacrylic acid wherein alkyl may include from 1 to about 20 carbon atoms, such as methyl methacrylate (e.g. 50 wt % to 90 wt %)/methacrylic acid (e.g. 0 wt % to 20 wt %)/ethylhexylacrylate (e.g. 10 wt % to 50 wt %)); ethylene-acrylate terpolymers: ethylene-acrylic esters-maleic anhydride (MAH) or glycidyl methacrylate (GMA) terpolymers; ethylene-acrylic acid ionomers and combinations thereof.

In some examples, the resin comprises a first polymer that is a copolymer of ethylene or propylene and an ethylenically unsaturated acid of either acrylic acid and methacrylic acid. In some examples, the first polymer is absent ester groups and the resin further comprises a second polymer having ester side groups that is a co-polymer of (i) a first monomer having ester side groups selected from esterified acrylic acid or esterified methacrylic acid, (ii) a second monomer having acidic side groups selected from acrylic or methacrylic acid and (iii) a third monomer selected from ethylene and propylene. The esterified acrylic acid or esterified methacrylic acid may be, respectively, a $C_1$-$C_{10}$ alkyl acrylic acid ester or a $C_1$-$C_{10}$ alkyl methacrylic acid ester, in some examples a $C_1$-$C_5$ alkyl acrylic acid ester or a $C_1$-$C_5$ alkyl methacrylic acid ester, in some examples a $C_1$-$C_3$ alkyl acrylic acid ester or a $C_1$-$C_3$ alkyl methacrylic acid ester.

At the beginning of the printing process, the resin may constitute 5% to 99% by weight of the solids in the ink composition, in some examples 50% to 90% by weight of the solids of the ink composition, in some examples 70% to 90% by weight of the solids of the ink composition. The remaining wt % of the solids in the ink composition may be the colorant and, in some examples, any other additives that may be present.

The ink composition used in the electrostatic printing process comprises particles comprising a resin. In some examples, the ink composition further comprises a liquid carrier, and the particles comprising a resin may be suspended in the liquid carrier. The ink composition may further comprise a colorant. The particles comprising the resin may further comprise a colorant. In some examples, the ink composition may substantially lack or lack a liquid carrier, and the particles may be in flowable form. In some examples, the ink composition may be in powder form.

As mentioned herein, the ink composition used in the electrostatic printing process may further comprise a liquid carrier, and the particles comprising a resin may be suspended in the liquid carrier. Generally, the liquid carrier acts as a dispersing medium for the other components in the ink. For example, the liquid carrier can comprise or be a hydrocarbon, silicone oil, vegetable oil, etc. The liquid carrier can include, but is not limited to, an insulating, non-polar, non-aqueous liquid that is used as the medium for toner particles. The liquid carrier can include compounds that have a resistivity in excess of about $10^9$ ohm-cm. The liquid carrier may have a dielectric constant below about 30, in some examples below about 10, in some examples below about 5, in some examples below about 3. The liquid carrier can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the liquid carriers include, but are not limited to, aliphatic hydrocarbons, isoparaffinic compounds, paraffinic compounds, dearomatized hydrocarbon compounds, and the like. In particular, the liquid carriers can include, but are not limited to, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™). The liquid carriers and other components of the present disclosure are described in U.S. Pat. No. 6,337,168, U.S. Pat. No. 6,070,042, and U.S. Pat. No. 5,192,638, all of which are incorporated herein by reference. The liquid carrier may be substantially removed or removed from the ink composition during or after the electrostatic printing process to form a solid ink on print substrate.

In some examples, the liquid carrier, at the beginning of the electrostatic printing process, constitutes about 20 to 99.5% by weight of the ink composition, in some examples 50 to 99.5% by weight of the ink composition. In some examples, the liquid carrier, at the beginning of the electrostatic printing process, constitutes about 40 to 90% by weight of the ink composition. In some examples, at the beginning of the electrostatic printing process, the liquid carrier constitutes about 60 to 80% by weight of the ink composition. In some examples, at the beginning of the electrostatic printing process, the liquid carrier may constitute about 90 to 99.5% of the electrostatic ink composition, in some examples 95 to 99% of the ink composition.

As mentioned herein, in some examples, the ink composition may further comprise a colorant. In some examples, the particles comprising the resin may further comprise a colorant. The colorant may be a dye or pigment. The colorant may be any colorant compatible with the liquid carrier, if used, and useful for electrostatic printing. For example, the colorant may be present as pigment particles, or may comprise a resin (in addition to the polymers described herein) and a pigment. The resins and pigments can be any of those commonly used as known in the art. In some examples, the colorant is selected from a cyan pigment, a magenta pigment, a yellow pigment and a black pigment. For example, pigments by Hoechst including Permanent Yellow DHG, Permanent Yellow GR, Permanent Yellow G, Permanent Yellow NCG-71, Permanent Yellow GG, Hansa Yellow RA, Hansa Brilliant Yellow 5GX-02, Hansa Yellow X, NOVAPERM® YELLOW HR, NOVAPERM® YELLOW FGL, Hansa Brilliant Yellow 10GX, Permanent Yellow G3R-01, HOSTAPERM® YELLOW H4G, HOSTAPERM®YELLOW H3G, HOSTAPERM® ORANGE GR, HOSTAPERM® SCARLET GO, Permanent Rubine F6B; pigments by Sun Chemical including L74-1357 Yellow, L75-1331 Yellow, L75-2337 Yellow; pigments by Heubach including DALAMAR® YELLOW YT-858-D; pigments by Ciba-Geigy including CROMOPHTHAL® YELLOW 3 G, CROMOPHTHAL® YELLOW GR, CROMOPHTHAL® YELLOW 8 G, IRGAZINE®YELLOW 5GT, IRGALITE® RUBINE 4BL, MONASTRAL® MAGENTA, MONASTRAL® SCARLET, MONASTRAL® VIOLET, MONASTRAL® RED, MONASTRAL® VIOLET; pigments by BASF including LUMOGEN® LIGHT YELLOW, PALIOGEN® ORANGE, HELIOGEN® BLUE L 690 IF, HELIOGEN® BLUE TBD 7010, HELIOGEN® BLUE K 7090, HELIOGEN® BLUE L 710 IF, HELIOGEN® BLUE L 6470, HELIOGEN® GREEN K 8683, HELIOGEN® GREEN L 9140; pigments by Mobay including QUINDO® MAGENTA, INDOFAST® BRILLIANT SCARLET, QUINDO® RED 6700, QUINDO® RED 6713, INDOFAST® VIOLET; pigments by Cabot including Maroon B STERLING® NS BLACK, STERLING® NSX 76, MOGUL® L; pigments by DuPont including TIPURE® R-101; and pigments by Paul Uhlich including UHLICH® BK 8200.

The electrostatic ink composition may include a charge director. The charge director is added to ink composition in order to impart an electrostatic charge on the ink particles. In some examples, the charge director may comprise ionic compounds, particularly metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. In some examples, the charge director is selected from, but is not limited to, oil-soluble petroleum sulfonates (e.g. neutral Calcium Petronate™, neutral Barium Petronate™, and basic Barium Petronate™), polybutylene succinimides (e.g. OLOA™ 1200 and Amoco 575), and glyceride salts (e.g. sodium salts of phosphated mono- and diglycerides with unsaturated and saturated acid substituents), sulfonic acid salts including, but not limited to, barium, sodium, calcium, and aluminum salts of sulfonic acid. The sulfonic acids may include, but are not limited to, alkyl sulfonic acids, aryl sulfonic acids, and sulfonic acids of alkyl succinates (e.g. see WO 2007/130069). In some examples, the charge director imparts a negative charge on the particles of the ink composition.

The charge director used herein can be any as known in the art such as described in U.S. Pat. No. 5,346,796, which is incorporated herein by reference in its entirety.

In some examples, the charge director comprises a sulfosuccinate moiety of the general formula [$R_1$—O—C(O)$CH_2CH(SO_3^-)$OC(O)—O—$R_{2'}$], where each of $R_{1'}$ and $R_{2'}$ is an alkyl group. In some examples, the charge director comprises nanoparticles of a simple salt and a sulfosuccinate salt of the general formula $MA_n$, wherein M is a metal, n is the valence of M, and A is an ion of the general formula [$R_1$—O—C(O)$CH_2CH(SO_3^-)$OC(O)—O—$R_{2'}$], where each of $R_{1'}$ and $R_{2'}$ is an alkyl group, or other charge directors as found in WO2007130069, which is incorporation herein by reference in its entirety. As described in WO2007130069, the sulfosuccinate salt of the general formula $MA_n$ is an example of a micelle forming salt. The charge director may be substantially free or free of an acid of the general formula HA, where A is as described above. The charge director may comprise micelles of said sulfosuccinate salt enclosing at least some of the nanoparticles. The charge director may comprise at least some nanoparticles having a size of 200 nm or less, in some examples 2 nm or more. As described in WO2007130069, simple salts are salts that do not form micelles by themselves, although they may form a core for micelles with a micelle forming salt. The ions constructing the simple salts are all hydrophilic. The simple salt may comprise a cation selected from the group consisting of Mg, Ca, Ba, $NH_4$, tert-butyl ammonium, $Li^+$, and $Al^{+3}$, or from any sub-group thereof. The simple salt may comprise an anion selected from the group consisting of $SO_4^{2-}$, $PO^{3-}$, $NO_3^-$, $HPO_4^{2-}$, $CO_3^{2-}$, acetate, trifluoroacetate (TFA), $Cl^-$, Bf, $F^-$, $ClO_4^-$, and $TiO_3^{4-}$, or from any sub-group thereof. The simple salt may be selected from $CaCO_3$, $Ba_2TiO_3$, $Al_2(SO_4)$, $A1(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof. The charge director may further comprise basic barium petronate (BBP).

In the formula [$R_{1'}$—O—C(O)$CH_2CH(SO_3^-)$OC(O)—O—$R_{2'}$], each of $R_{1'}$ and $R_{2'}$ may be an aliphatic alkyl group. In some examples, each of $R_{1'}$ and $R_{2'}$ independently is a $C_{6-25}$ alkyl. In some examples, said aliphatic alkyl group is linear. In some examples, said aliphatic alkyl group is branched. In some examples, said aliphatic alkyl group includes a linear chain of more than 6 carbon atoms. In some examples, $R_{1'}$ and $R_{2'}$ are the same. In some examples, at least one of $R_{1'}$ and $R_{2'}$ is $C_{13}H_{27}$. In some examples, M is Na, K, Cs, Ca, or Ba. The formula [$R_1$—O—C(O)$CH_2CH(SO_3^-)$OC(O)—O—$R_{2'}$] and/or the formula $MA_n$ may be as defined in any part of WO2007130069.

The charge director may comprise (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulphonate salt is dodecyl benzene sulfonic acid isopropyl amine, which is available from Croda. The charge director may be as described in U.S. Pat. No. 5,266,435, which is incorporated herein by reference in its entirety.

In some examples, the charge director constitutes about 0.001% to 20%, in some examples 0.01 to 20% by weight, in some examples 0.01 to 10% by weight, in some examples 0.01 to 1% by weight of the solids of the electrostatic ink composition. In some examples, the charge director constitutes about 0.001 to 0.15% by weight of the solids of the electrostatic ink composition, in some examples 0.001 to 0.15%, in some examples 0.001 to 0.02% by weight of the solids of the electrostatic ink composition. In some examples, the charge director imparts a negative charge on the particles. The particle conductivity may range from 50 to 500 pmho/cm, in some examples from 200-350 pmho/cm.

In aspect, there is provided a print substrate printed with an ink according to the method for electrostatic printing described herein.

In an aspect, there is provided a print substrate having a layer comprising a polymeric material, the layer comprising a polymer having thereon a surface layer comprising amino-functional oligomericsiloxane. The print substrate may be printed with an electrostatic ink according to the method described herein.

EXAMPLES

The following examples illustrate a number of variations of the present methods and related aspects that are presently known to the inventors. However, it is to be understood that the following are only exemplary or illustrative of the application of the principles of the present methods and related aspects. Numerous modifications and alternative methods may be devised by those skilled in the art without departing from the spirit and scope of the present methods and related aspects. The appended claims are intended to cover such modifications and arrangements. Thus, while the present methods and related aspects have been described above with particularity, the following examples provide further detail in connection with what are presently deemed to be acceptable.

The present inventors demonstrated the interaction between amino groups in aminosilane by the following experiment: different organofunctional silane ester reagents were mixed with a dispersion of an ethylene methacrylic resin used in some liquid electrostatic printing inks. The resin was dispersed in Isopar L. FTIR measurements shown in FIG. 1 indicate that the amino-containing silanes interacted with the acidic groups. The decrease of acid COOH (1703 $cm^{-1}$) peak together with appearance of new broad amine peak in the area 1550 $cm^{-1}$ (after rinsing the polymer from reagents residues) indicate interaction between polymer and amino containing silanes. This behaviour was not observed when non-amino silane coupling agents were used (glycidoxypropylmethyldimethoxysilane, chloropropyl trimethoxysilane, and hexadecyltrimethoxysilane).

Figure 2:
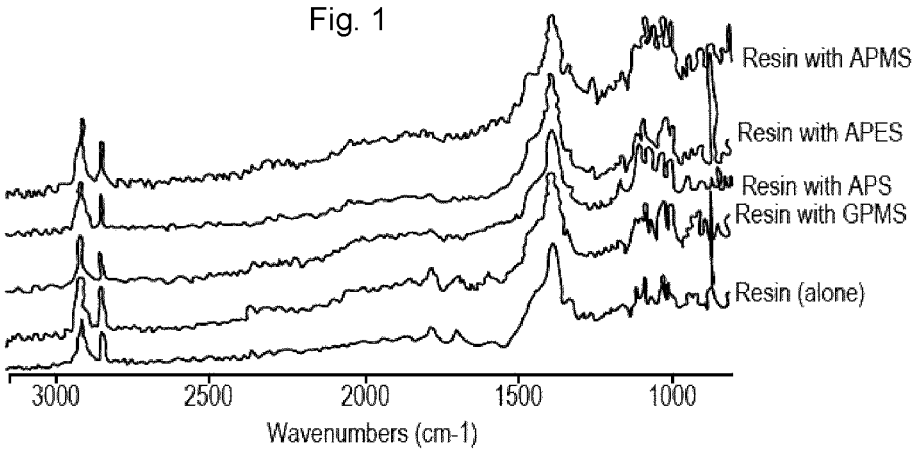
FIG. 2 shows IR spectra for an acidic resin after reaction with certain organosilanes, some of which were aminofunctional silanes. More detail is given in the Examples below.

It is shown in FIG. 2 that amine acid interaction took place when the following materials were mixed with dispersed ethylene methacrylate resin; 2-aminoethyl-3-aminopropyl-methyldimethoxysilane (APMS), aminopropyltriethoxysilane (APES) and aminopropyl-trimethoxysilane (APS). No change in the COOH (1703 $cm^{-1}$) peak took place when epoxy silane glycidoxy-propyl-trimethoxysilane (GPMS) was mixed with dispersed ethylene methacrylate resin.

Organosilanes may be solubilised in water. Adjustment of pH stabilizes the material in water. The protective alkoxy groups are removed from the solution and an aqueous solution with no volatile organic compounds (VOC) is obtained. Applying organosilanes from water is an advantage.

Coating Trials and Results

In this disclosure the present inventors introduced in-line priming with aminosilane. The aminosilanes used were aqueous aminosilane solutions, although non aqueous aminosilane could be applied as well. Dynasylan® HYDROSIL 2627 does not contain any alcohols and is based on an oligomeric structure therefore no VOC (volatile organic compounds) are emitted during the coating process. Dynasylan® HYDROSIL 2909 and 2776 can be applied as primers as well. The present inventors found that Dynasylan® HYDROSIL 2926 did not improve adhesion of liquid electrostatic printing (LEP) inks to polymeric substrate as the other mentioned Dynasylan® HYDROSIL—this composition is an aqueous solution based on an epoxy-silane compound (rather than an aminofunctional silane), which does not show interaction with the LEP ink. In each of the tests below, the Ink used was HP Electroink 4.5, available from Hewlett Packard.

Bi oriented polypropylene (BOPP) 38 micron thick, pearl as well as transparent, was treated by corona, with the power varied from 400 to 800 W, prior to coating with the described primer. Dynasylan® HYDROSIL 2627 was applied using an in-line roller-based coating system. The coated substrate was dried with forced heated air temp between 60-80° C. prior to printing. The primed BOPP was printed using a 7200 HP indigo printer. Peel tests demonstrate that the aminosilane is a very efficient adhesion promoter between LEP ink and polymeric substrates. Peel tests were carried out according to FINAT test method (FTM 21 Test Method no. 21)

The adhesion of LEP inks to some paper based substrates such as wine labels can also be problematic. In another experiment, same coating and printing system were used to prime paper substrate used for wine labels (supplied by Nirotek, Israel), the paper was primed with Dynasylan® HYDROSIL 2627 prior to printing. Peel tests demonstrate that the priming with aminosilane improved drastically the adhesion between LEP ink and paper based substrate. Peel tests were carried out according to FINAT test method (FTM 21 Test Method no. 21).

The wine labels had a grammage (ISO 536) of 80 $g/m^2$±4; a thickness (ISO 534) of 122 microns±8; a bulk (ISO 534) of 1.53; a stiffness (angle of 15°) SM (ISO 2492) of 0.65 mNm and ST (ISO 2492) of 0.39 mNm; a smoothness Bekk (BS) (ISO 5627) of 10 s; a moisture content (ISO 287-638) of 6%+/−1; an opacity—dry (ISO 2471-1977) of 88%; an opacity—dry (ISO 2471-1977) of 70%; a tensile strength—dry MD (ISO 1924 55) of N/15 mm, a tensile strength—dry CD (ISO 1924 33) of N/15 mm; a water Cobb (60 sec.) (ISO 235-5637) of 18 $g/m^2$; and CIE Whiteness (ISO 105-J02) of 140.

Wet coating weight range varied from 0.5 to 0.8 GSM. The concentration of the active material in Dynasylan® HYDROSIL 2627 in the trials described varied between 10%-20%. Consequently the dry coat weight varied between 0.05 to 0.16 GSM.

While the invention has been described with reference to certain examples, those skilled in the art will appreciate that various modifications, changes, omissions, and substitutions can be made without departing from the spirit of the disclosure. It is intended, therefore, that the present method and related aspects be limited only by the scope of the following claims. Unless otherwise stated, the features of any dependent claim can be combined with the features of any of the other dependent claims.

The invention claimed is:

1. A method for liquid electrostatic printing (LEP), comprising:

providing a print substrate having a layer of a polymeric material thereon;

then applying an aminofunctional silane primer to the layer using an in-line roller-based coating system to form a primer-coated substrate;

drying the primer-coated substrate with forced heated air; and carrying out a liquid electrostatic printing process to transfer an ink onto the layer, the ink including a resin having an acidic side group;

wherein adhesion between the ink and the print substrate occurs due to an interaction between the aminofunctional silane primer and the acidic side group;

and wherein the providing, applying, drying, and carrying out are accomplished in an in-line print process.

2. The method according to claim 1, wherein the aminofunctional silane primer is an am inofunctional oligomericsiloxane.

3. The method according to claim 1, wherein the aminofunctional silane primer is a non-halogenated aminofunctional oligomericsiloxane.

4. The method according to claim 2, wherein the aminofunctional oligomericsiloxane is obtainable by mixing an aminoalkoxysilane of formula I $$R^a—Si(R^b)_y(OR^c)_{3-y} \quad (I)$$

with an alkylalkoxysilane of formula II $$R^d—Si(OR^e)_3 \quad (II)$$

and/or dialkyldialkoxysilanes of the formula (II)*

$$BB'—Si(OR^f)_2 \quad (II)^*$$

wherein $R^a$ is an aminofunctional group, $R^b$, $R^c$, $R^e$ and $R^f$ are each independently an alkyl group, $R^d$ is an alkyl, alkene or a ureido-alkyl group, and B and B' are each independently an alkyl group or an alkene group, and $0 \leq y \leq 1$.

5. The method according to claim 1, wherein the polymeric material comprises a plastic.

6. The method according to claim 5, wherein the plastic is selected from polyethylene terephthalate (PET), a polyalkylene, polyvinylchloride, polycarbonate, and styrene-butadiene.

7. The method according to claim 1, wherein the print substrate comprises a cellulosic paper.

8. The method according to claim 1, wherein the aminofunctional silane primer is applied to the layer of the polymeric material in a stabilized aqueous composition.

9. The method according to claim 1, wherein the ink comprises a resin comprising a first polymer that is a copolymer of ethylene or propylene and an ethylenically unsaturated acid of either acrylic acid and methacrylic acid.

10. The method according to claim 9, wherein the first polymer is absent ester groups and the resin further comprises a second polymer having ester side groups that is a co-polymer of (i) a first monomer having ester side groups selected from esterified acrylic acid or esterified methacrylic acid, (ii) a second monomer having acidic side groups selected from acrylic or methacrylic acid and (iii) a third monomer selected from ethylene and propylene.

11. The method according to claim 1, further comprising, prior to applying the aminofunctional silane primer, exposing the layer to a corona treatment.

* * * * *